US012497138B2

(12) United States Patent
Pierce

(10) Patent No.: US 12,497,138 B2
(45) Date of Patent: Dec. 16, 2025

(54) COMBINATION SINGLE AND DOUBLE HULL WATERCRAFT

(71) Applicant: Edward Alan Pierce, Wilmington, NC (US)

(72) Inventor: Edward Alan Pierce, Wilmington, NC (US)

( * ) Notice: Subject to any disclaimer, the term of this patent is extended or adjusted under 35 U.S.C. 154(b) by 0 days.

(21) Appl. No.: 18/755,836

(22) Filed: Jun. 27, 2024

(65) Prior Publication Data

US 2024/0343353 A1 Oct. 17, 2024

Related U.S. Application Data

(63) Continuation-in-part of application No. 29/875,178, filed on Apr. 29, 2023, now Pat. No. Des. 1,039,468, which is a continuation-in-part of application No. 29/788,252, filed on Apr. 19, 2021, now Pat. No. Des. 1,039,467, which is a continuation-in-part of application No. 29/652,177, filed on Jun. 3, 2020, now Pat. No. Des. 1,038,863.

(60) Provisional application No. 63/499,216, filed on Apr. 29, 2023.

(51) Int. Cl.

| | |
|---|---|
| ***B63B 32/55*** | (2020.01) |
| ***B63B 32/40*** | (2020.01) |
| ***B63B 32/51*** | (2020.01) |
| ***B63B 32/57*** | (2020.01) |

(52) U.S. Cl.

CPC ..... *B63B 32/55* (2020.02); *B63B 32/40* (2020.02); *B63B 32/51* (2020.02); *B63B 32/57* (2020.02)

(58) Field of Classification Search

CPC ..... B63B 32/00; B63B 32/40; B63B 32/50; B63B 32/51; B63B 32/55; B63B 32/57

USPC ..... 441/65, 66, 74

See application file for complete search history.

(56) References Cited

U.S. PATENT DOCUMENTS

| | | | | |
|---|---|---|---|---|
| 4,302,859 | A * | 12/1981 | Kozminski | B63B 32/40 441/74 |
| 4,894,035 | A | 1/1990 | Pia | |
| 5,605,110 | A | 2/1997 | Talbot | |
| 6,112,692 | A | 9/2000 | Lekhtman | |
| 6,347,599 | B1 * | 2/2002 | Hendrickson | B63B 32/70 441/74 |
| 6,435,123 | B1 | 8/2002 | Ødegard | |
| 6,871,608 | B2 | 3/2005 | Rosen | |
| 7,182,037 | B2 * | 2/2007 | Otobe | B63B 34/21 441/74 |
| 8,281,730 | B2 | 10/2012 | Munson | |
| 8,752,492 | B1 | 6/2014 | Harris | |
| 9,061,735 | B2 | 6/2015 | Heyring et al. | |
| 9,199,702 | B2 | 12/2015 | Cregier et al. | |
| 9,248,890 | B2 | 2/2016 | Raaphorst | |
| 9,545,981 | B1 | 1/2017 | Ebrahimi | |
| 9,623,937 | B2 | 4/2017 | Moffat, III et al. | |
| 10,618,608 | B2 | 4/2020 | Leslie | |

(Continued)

*Primary Examiner* — Daniel V Venne

(74) *Attorney, Agent, or Firm* — Dunlap Bennett & Ludwig, PLLC; Anna L. Kinney

(57) ABSTRACT

A paddleboard with a multi-hull underbody includes pontoons defining a parallel-walled channel from nose to tail and an upper deck monolithically joined to the pontoons. The upper deck has longitudinal edges contiguous with an outer curvature of the pontoons. The paddleboard exhibits improved ease of use, speed, stability, energy efficiency, and tracking for both recreational and racing use.

12 Claims, 5 Drawing Sheets

(56) References Cited

U.S. PATENT DOCUMENTS

| | | | | |
|---|---|---|---|---|
| 2013/0280971 | A1 | 10/2013 | Dovell | |
| 2015/0033997 | A1 | 2/2015 | Groves et al. | |
| 2016/0194063 | A1* | 7/2016 | Knowles | B63B 32/64<br>441/74 |
| 2016/0368564 | A1 | 12/2016 | Yattaw et al. | |
| 2019/0112013 | A1 | 4/2019 | Parker | |

* cited by examiner

COMBINATION SINGLE AND DOUBLE HULL WATERCRAFT

CROSS-REFERENCE TO RELATED APPLICATION

This application claims the benefit of priority of U.S. provisional application No. 63/499,216, filed Apr. 29, 2023, the contents of which are herein incorporated by reference. This application is also a continuation in part of U.S. application Ser. No. 29/875,178, filed Apr. 29, 2023. Application Ser. No. 29/875,178 is a continuation-in-part of U.S. application Ser. No. 29/788,252, filed Apr. 19, 2021. U.S. application Ser. No. 29/788,252 is a continuation-in-part of U.S. application Ser. No. 29/652,177, filed Jun. 3, 2020. The disclosures of application Nos. 63/499,216, Ser. Nos. 29/875,178, 29/788,252, and 29/652,177 are incorporated herein in their entireties.

BACKGROUND OF THE INVENTION

The present invention relates to watercraft and, more particularly, to combination single and double hull watercraft.

Modern Stand Up Paddleboard (SUP) designs and construction are a product of the surf industry. Early stand-up paddle boards (SUPs) were very user friendly (i.e., easy to stand on), looked like oversized surf longboards and were constructed with the same processes and materials. Shortly after SUPs introduction, races for stand-up paddle boards began to organize. There are hundreds of SUP race events across the United States annually, and easily as many in other parts of the world.

With the increased popularity of racing SUPs came the motivation to find ways to improve speed through the water. The unique requirements of race SUPs necessitate a full deck. Gradually, the design changed to make them faster. Noses and tails (i.e., the front and back of the board) became more pointed and the width of the board became narrower. To make these narrower shapes more stable with a lower center of gravity, indented cockpits formed in the decks, eventually giving way to dugout places to stand below the water line in many designs. The latter of these developments made it very difficult to re-board the craft after falling into the water. These extremely narrow, difficult to stand on vessels are now only successfully ridden by the best of the best athletes. Wider versions of these current designs are also available for non-professionals, but it should be noted the added width results in much slower performance. Design characteristics that remain the same are the relatively flat bottom contour for speed when sprinting, hard rails for stability (sharply turned edges between side wall and bottom surface) and a single large, surf style symmetrical fin for directional control and some improvement in overall stability.

The flat-bottomed designs have their tipping point axis directly in the middle of the board. When the weight of the paddler is distributed equally on either side of this point, the board feels stable and in balance. Paddling, the active state of propulsion, requires dynamic body movement, which constantly varies the paddler's weight distribution through the feet. This results in a tippy sensation (lack of stability) in all but the widest of designs. However, wide, flat-bottomed hulls suffer from a loss of speed due to the increased wetted surface area beyond the need for buoyancy. They also suffer from diminished tracking (i.e., the tendency to move in a straight line).

Current mono hull designs employ symmetrical hull shapes and a single deep symmetrical fin, which do not create lift (referring herein to increased forward propulsion). The single large fin is mounted perpendicular to the bottom contour in the aft area of the SUP.

Moreover, current Race SUPs employ small channeled, centrifugal, or Venturi style drainage which is slow and inefficient to drain.

Recreational SUPs (non-racing designs) represent the vast majority of the overall standup paddleboard market. The cost of construction is a major consideration in the recreational category. As a result, their design is much simpler and has remained little changed from their predecessors. Like Race SUPs they feature a flat bottom design. They differ from race SUPs, in overall dimensions, which are shorter, and wider than Race SUPs. The nose and tail taper less than race designs with generally round blunt noses and wider, squared off tails. all of these attributes contribute to their overall stability making them easier to stand on. As a result, creating a cockpit or dugout is unnecessary in recreational paddle boards. Unfortunately, these shorter wider SUPs while stable, and user-friendly, perform very poorly in every other criterion and are only suitable on calm days on inland, flat-water conditions.

As can be seen, there is a need for a Stand Up Paddleboard that improves on current deficiencies in both the race and recreational categories.

SUMMARY OF THE INVENTION

In one aspect of the present invention, a paddleboard with a multi-hull underbody comprises pontoons defining a parallel-walled channel therebetween from nose to tail; and an upper deck monolithically joined thereto and having longitudinal edges contiguous with an outer curvature of the pontoons.

The present invention provides a combination single and double hull watercraft exhibiting improved performance characteristics of ease of use, speed, stability, energy efficiency, and tracking. These characteristics are equally desirable in recreational Stand-Up Paddle Boards and in racing boards. This design may be applicable with similar benefits for most other self-propelled (human propelled) watercraft, including but not limited to prone paddle boards, canoes, kayaks, and rowboats.

These and other features, aspects and advantages of the present invention will become better understood with reference to the following drawings, description and claims.

DETAILED DESCRIPTION OF THE INVENTION

Figure 1:
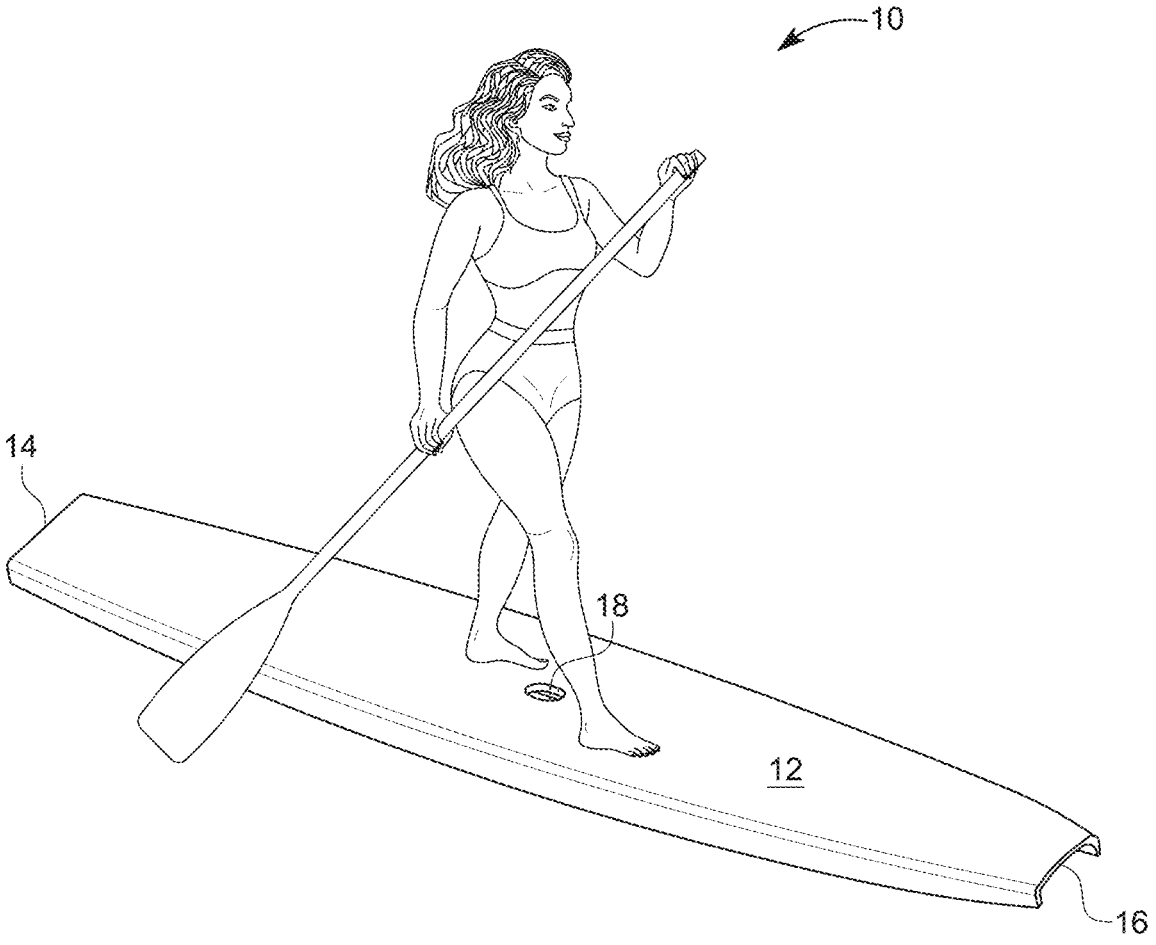
FIG. 1 is a top front perspective view of a combination single and double hull watercraft according to an embodiment of the present invention, shown in use.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

As used herein, the term "tracking" refers to the tendency to move in a straight line.

The term "wetted surface area" refers to is the number of square inches in contact with water.

As used herein, "nose" refers to the front of a stand-up paddleboard. "Tail" refers to the rear of the stand-up paddleboard. "Rocker" refers to a slight curvature from tip (or nose) to tail.

The term "soft rails" refers to a gradual transitional curve to the outer and inner hull walls. "Hard rails" refers to sharply turned edges between side wall and bottom surface.

Broadly, an embodiment of the present invention provides an easy-to-use, race capable, stand-up paddleboard (SUP) with superior performance (e.g., speed, stability, energy efficiency, and tracking), when compared to designs on the market at the time of filing, in a wide variety of sea state conditions.

The mono block, Combination Single and Double Hull Watercraft (CSDHW) design combines the best attributes of the prior art single hull cockpit race SUP deck designs with the underbody of a catamaran multihull, thereby achieving surprisingly superior results. The CSDHW may be monolithic, i.e., the deck and the double hull may be formed as one piece.

Most catamaran style vessels have a central deck area with pontoons protruding forward and aft of this area. This configuration is unacceptable for a racing SUP. Moreover, a prior art catamaran watercraft design can become a liability in certain sea conditions on a SUP. The present invention overcomes these disadvantages.

The CSDHW, when viewed from above or from the side, appears like most modern-day prior art race SUPs. The exceptions are its broader, blunt nose, and cut out handle in the center of the cockpit. Turning the CSDHW over reveals a deep parallel walled center channel running the entire length, flanked by two wing-like, foil shaped pontoons. The outline curvature of the upper deck is contiguous with the outer curvature of the foil shaped pontoons below. The bottom of the pontoons is relatively flat with a somewhat gradual transitional curve to the outer and inner walls (referred to as soft rails in the surf industry). Both the pontoon bottoms and the top of the channel follow a slight curvature from tip (nose) to tail (referred to as rocker in the surf industry). Located near the tail of each pontoon is an industry standard surf fin box configured to accommodate a fin of the user's choice. Overall, the CSDHW SUP speed, efficiency, stability, and tracking are primarily a function of the pontoon's interaction with the water.

How well wetted surface area is managed and minimized is the largest single factor in determining overall performance for Stand-Up Paddleboards. Wetted surface is determined at least in part by the buoyancy needed to compensate for the paddler's weight. The CSDHW design divides the wetted surface area into two separate, highly efficient hull shapes (pontoons). These pontoons mimic the wetted surface area of the most efficient modern racing SUPs.

The CSDHW paddleboard benefits from two sources of hydrodynamic lift (i.e., greater efficiency through the water): asymmetrical foil-shaped pontoons and twin, asymmetrical, surf fins.

The asymmetrical foil shaped pontoons allow the CSDHW to retain a similar footprint to modern prior art successful race SUP designs. This outer footprint is narrower in the bow and tail and wider in the middle of the board. The narrow bow facilitates race drafting (catching and riding small bumps created by competitor's boards in the lead). The narrower tail makes the shape more forgiving and easier to ride waves. The asymmetrical foil shaped pontoons create lift, reducing the resistance to forward momentum through the water.

The CSDHW configuration disclosed herein significantly improves horizontal stability without diminishing overall speed. Through its multi hull underbody, the inventive SUP divides and moves the tipping point axis under each individual hull, eliminating a tippy sensation and providing a stable platform. This allows the paddler to focus on paddling technique without the need to expend excessive energy and focus on balance. The horizontal stability created by the design is improved so substantially that the benefits of cockpits and dugouts are all but eliminated, reducing the complexity and cost of production for the CSDHW.

The air/water flow channel of the CSDHW creates stability by distributing the buoyancy of the pontoons to the outer edges of the hull form's width. It also creates a clear un-impinged area for water to flow between the pontoons with sufficient area above the waterline to reduce overall wetted surface area. This reduced wetted surface area improves efficiency, requiring less effort for propulsion and greater speed. The centered channel also provides far superior tracking (tendency to travel in a straight line).

The CSDHW catamaran-style underbody approximately doubles the inherent tracking of prior art monohull SUPs. This is primarily due to the increase in the vertical structure surface area of the sidewalls below the waterline (catamaran four side walls vs. mono hull two side walls). This becomes even more evident when traversing in crosswind conditions.

The curvature/low pressure side of the pontoon is on the outside edge of the hull shape. The generally flat, inside edge of the pontoon minimizes wave creation in the channel, further reducing wetted surface area and improving efficiency. The bottom surfaces of the pontoons gives enough surface area for the CSDHW to effectively get up and plane on the surface of the water when maximum effort is applied through paddling technique. This significantly increases the actual speed beyond the theoretical hull speed. Achieving a plane state on the pontoon hulls is beneficial for race starts, passing situations, race finishes, or surfing situations in either downwind conditions or open ocean waves.

In downwind and wave surfing conditions, the contiguous and covered foredeck of the inventive SUP provides substantial added positive buoyancy to the relatively narrow pontoons, providing lift and minimizing the risk of the bow being buried in the trough of a wave.

The contiguous and covered afterdeck provides an extended standing area all the way to the tail for surfing in larger waves, as well as performing pivot turns around buoy markers, common in paddleboard races.

The CSDHW design needs as little as 4 inches of water to pass over the bottom without making contact. This is due to a combination of buoyancy distribution and its use of twin surf-style fins, which are less than half the depth of single fins used on mono hull style boards. This is a huge advantage when racing or exploring shallow coastal areas, or anywhere sandbars and shoals exist.

In some embodiments, the stand-up paddleboard disclosed herein has a through cut handle which provides a central large drain. The through cut deck handle also provides an air breather hole which prevents vacuum suction buildup in the channel between the pontoons. The overall length of the race version of the CSDHW may be 14 feet, which is the industry race standard. However, the paddleboard of the present subject matter is not limited thereto. The width is a function of the buoyancy needed for the user's body weight and the biomechanical optimal width for the user. Generally, the width may be between about 22 inches and about 27 inches, but is not limited thereto.

All the currently accepted best practices for physical operation of stand-up paddleboard propulsion work equally well on the CSDHW design and require no modification of either method, style, or paddles employed to operate.

Inflatables have become increasingly popular for their convenience of transport. The CSDHW stand up paddleboard design would be particularly appropriate for inflatable construction. Inflatable paddleboards have the disadvantage of a lack of longitudinal stiffness. The twin pontoon under body (multiple I-beams) provides significant improvement in this deficiency.

The materials of manufacture are not particularly limited. For example, the paddleboard may be manufactured of Expanded Polystyrene (EPS) foam or carbon fiber encapsulated in either fiberglass or carbon fiber cloth with epoxy resin. Alternatively, the paddleboard may be manufactured of an inflatable polymer or coated fabric body.

The method of manufacture is not particularly limited. For example, the paddleboard may have a foam core shaped from CAD drawings and then encapsulated. This is the most common method for manufacture of prior art stand-up paddle boards. Other appropriate methods of manufacture include, but are not limited to, injection molded, roto molded, hollow, core fiber/carbon and inflatable hyperon or PVC fabric.

Referring now to FIGS. 1 through 7, a stand up paddleboard 10 having a planar, mono block, single hull deck 12 contiguous with catamaran style multihull underbody (see FIG. 2) is shown in FIG. 1. The deck 12 has a nose or front end 16, a tail or aft end 14, and a through cut cockpit handle and air breather hole 18 formed therein.

Figure 2:
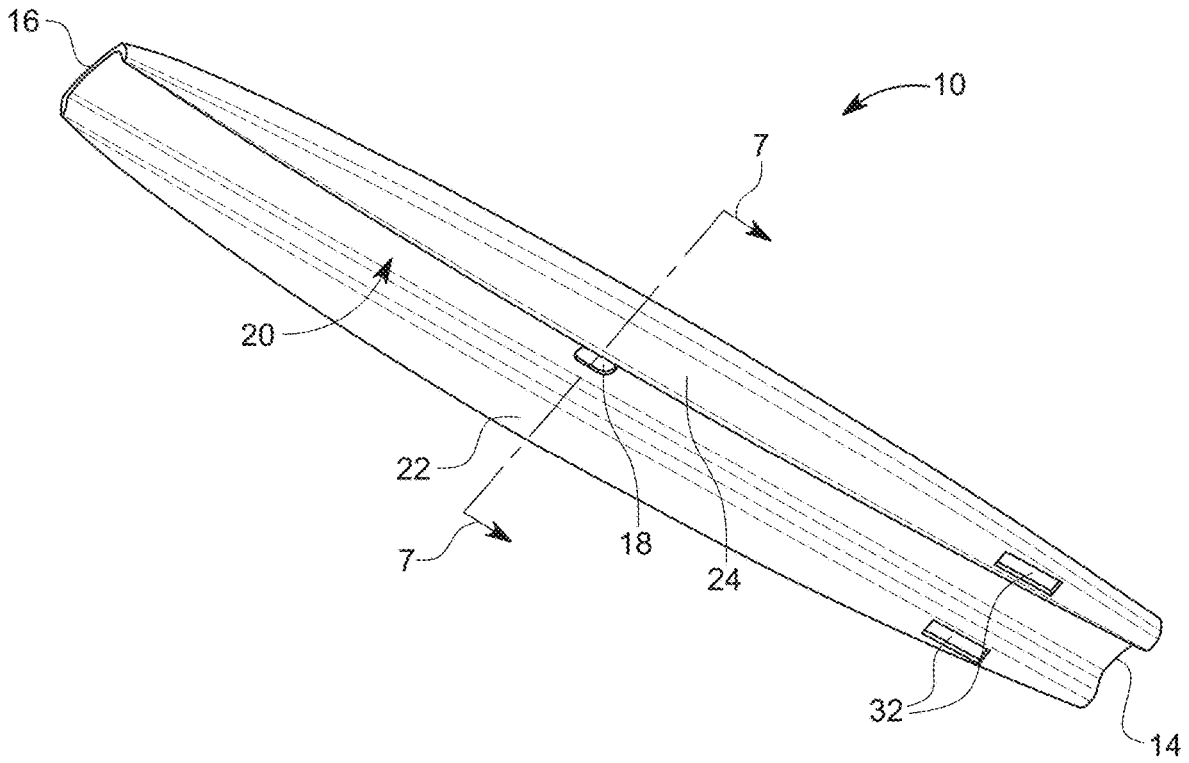
FIG. 2 is a bottom rear perspective view thereof.

Turning to FIG. 2, the paddleboard 10 has asymmetrical (front to rear) foil shaped floats or pontoons 22, 24 with a full-length air/water flow channel 20 formed therebetween. Twin fin boxes 32 in the aft underbody of the pontoons 22, 24 are each operative to accommodate a fin (not shown) for additional directional stability (tracking) and lift (increased forward, momentum). See also FIG. 4, which more clearly shows the asymmetrical nature of the relative curvature of the inner and outer walls of the pontoons 22, 24. In some embodiments, the fore end 16 taper 26 differs as compared to the aft end 14 taper 28.

Figure 3:
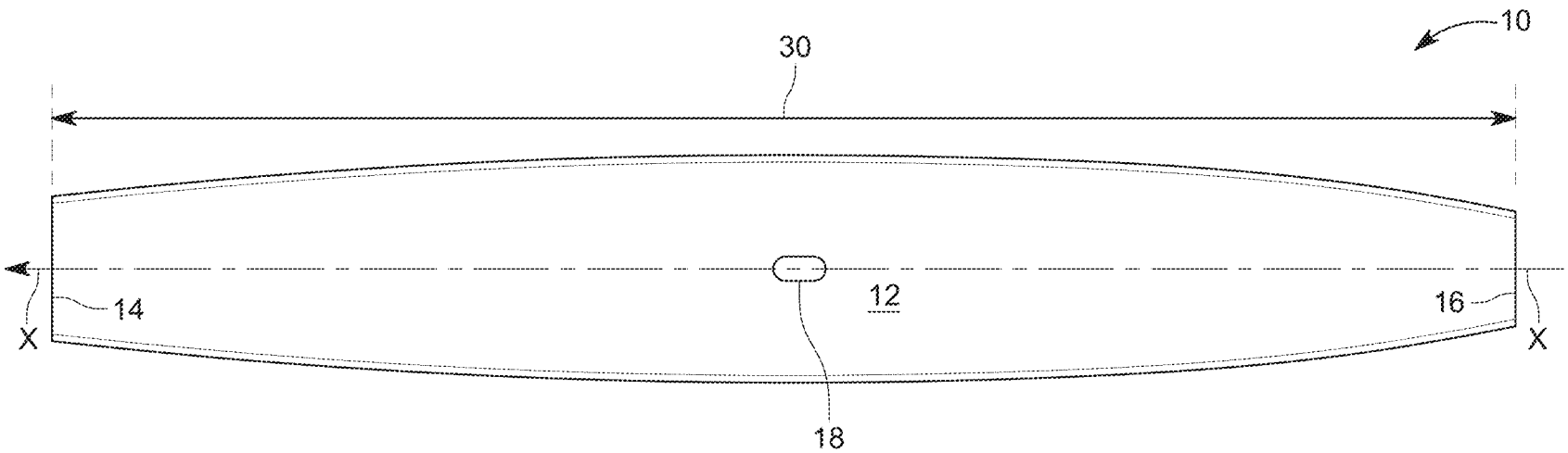
FIG. 3 is a top plan view thereof.
Figure 4:
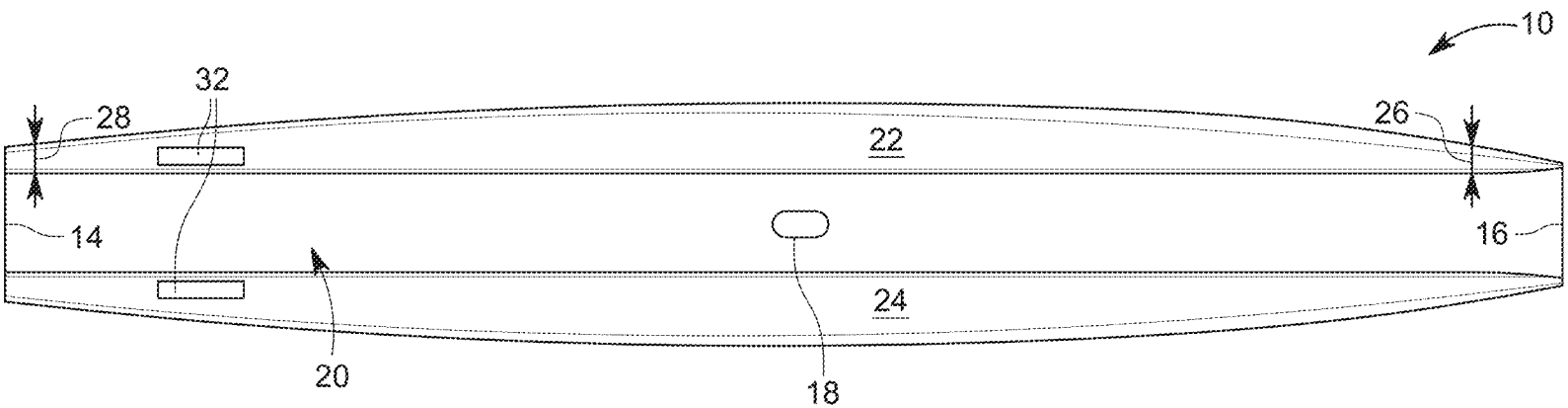
FIG. 4 is a bottom plan view thereof.

FIG. 3 illustrates the overall length 30 and central longitudinal axis X of the paddleboard.

Figure 5:
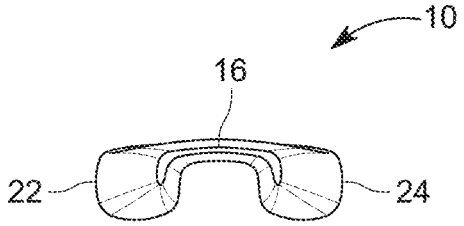
FIG. 5 is a front elevation view thereof.
Figure 6:
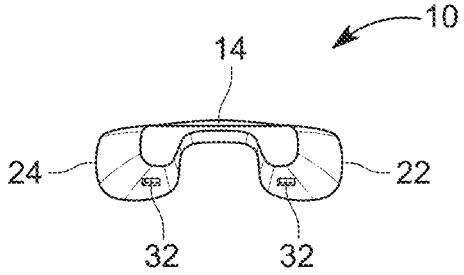
FIG. 6 is a rear elevation view thereof.

As shown in FIGS. 5 and 6, the deck 12 and pontoons 22, 24 are joined with rounded edges. The distinction between the tapers of the fore 16 and aft 14 ends of the pontoons 22, 24 are also shown in FIGS. 5 and 6.

Figure 7:
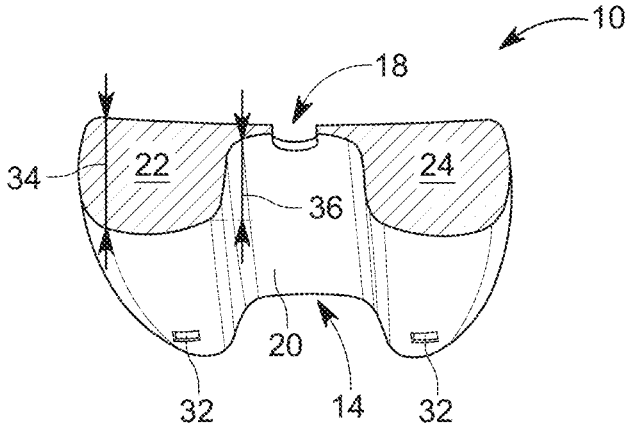
FIG. 7 is a sectional view thereof, taken along line 7-7 in FIG. 2.

Turning to FIG. 7, the channel 20 depth 36 is about equal to the overall height 34 of the paddleboard 10 minus a height of the deck 12.

It should be understood, of course, that the foregoing relates to exemplary embodiments of the invention and that modifications may be made without departing from the spirit and scope of the invention as set forth in the following claims.

What is claimed is:

1. A paddleboard (10) with a multi-hull underbody, comprising:

pontoons (22, 24) defining a continuous, parallel-walled channel (20) therebetween extending from nose (16) to tail (14); and an upper deck (12) monolithically joined thereto and having longitudinal edges contiguous with an outer curvature of the pontoons (22, 24);

wherein the nose and tail of the paddleboard are narrower than a central portion thereof; and wherein the parallel-walled channel has sidewalls normal to an upper surface of the upper deck.

2. The paddleboard (10) of claim 1, wherein the pontoons (22, 24) each have an outer wall and an inner wall, wherein the outer wall has a curved surface longer than a surface of the inner wall, and wherein the inner wall forms one wall of the parallel-walled channel (20).

3. The paddleboard (10) of claim 1, wherein the pontoons (22, 24) each have a substantially flat base curving gradually to form the outer curvature of the pontoons (22, 24) and the walls of the parallel-walled channel (20).

4. The paddleboard (10) of claim 1, wherein each of the pontoons (22, 24) comprises a finbox (32) proximal to a tail (14) thereof, operative to accommodate a fin.

5. The paddleboard (10) of claim 1, wherein the upper deck (12) further defines a through-cut cockpit handle (18).

6. The paddleboard (10) of claim 1, wherein the upper deck (12) is substantially planar.

7. The paddleboard (10) of claim 1, wherein the pontoons (22, 24) and upper deck (12) are formed of polymer foam encapsulated in a fibrous layer.

8. The paddleboard (10) of claim 1, wherein the pontoons (22, 24) and upper deck (12) form an inflatable body.

9. The paddleboard (10) of claim 1, wherein each of the pontoons (22, 24) tapers (26, 28) at the nose (16) and at the tail (14) such that each of the pontoons (22, 24) is narrower at the nose than at the tail.

10. The paddleboard (10) of claim 1, wherein the paddleboard (10) has a longitudinal axis (X) and an overall length (30).

11. The paddleboard (10) of claim 1, wherein the paddleboard (10) has an overall height (34) and the parallel-walled channel (20) has a depth (36) less than the overall height (34).

12. The paddleboard (10) of claim 1, wherein the multi-hull underbody comprises the pontoons and wherein the number of pontoons is two.

* * * * *